US007465858B2

(12) United States Patent
Beckwith

(10) Patent No.: US 7,465,858 B2
(45) Date of Patent: Dec. 16, 2008

(54) STRINGED MUSICAL INSTRUMENT

(76) Inventor: Scott A. Beckwith, 12111 Ranch Rd. 12, Suite 203B, Wimberley, TX (US) 78676

( * ) Notice: Subject to any disclaimer, the term of this patent is extended or adjusted under 35 U.S.C. 154(b) by 0 days.

(21) Appl. No.: 11/725,911

(22) Filed: Mar. 19, 2007

(65) Prior Publication Data

US 2008/0229895 A1 Sep. 25, 2008

(51) Int. Cl.
*G10D 1/08* (2006.01)

(52) U.S. Cl. ..... 84/267; 84/291

(58) Field of Classification Search ..... 84/267, 84/290, 291

See application file for complete search history.

(56) References Cited

U.S. PATENT DOCUMENTS

| | | | | |
|---|---|---|---|---|
| 2,813,448 | A | 11/1957 | Robinson | |
| 4,078,468 | A | 3/1978 | Civitello | |
| 4,506,585 | A | 3/1985 | Desmond | |
| 4,576,080 | A | 3/1986 | McLellan et al. | |
| 5,431,079 | A * | 7/1995 | Bunker | 84/313 |
| 5,485,773 | A | 1/1996 | Devitrysmith | |
| 5,814,746 | A * | 9/1998 | Stafford | 84/313 |
| 6,528,710 | B2 | 3/2003 | Steinberger | |

* cited by examiner

*Primary Examiner*—Kimberly R Lockett
(74) *Attorney, Agent, or Firm*—Carothers & Carothers

(57) ABSTRACT

A stringed musical instrument, such as a guitar, having a body with a neck secured to the body and over which are laterally stretched substantially parallel strings, which strings are stretched over a bridge mounted on the body upper face between a tuning key disposed on a head at a distal end of the neck and initial points of termination on the body upper face with the bridge disposed on the upper face intermediate the keys and the initial points of termination. The complete termination arrangement for the strings is comprised of channels in the body for each of the strings which extend from the initial points of termination to final points of terminal securement on the body displaced laterally from the initial points of termination with the strings stretched over a dense non-displaceable surface. Accordingly, the strings are thereby further lengthened beyond the bridge in order to subject the strings to greater tension for a specified musical pitch to provide increased resonance and performance.

4 Claims, 3 Drawing Sheets

STRINGED MUSICAL INSTRUMENT

BACKGROUND OF THE INVENTION

This invention relates generally to stringed instruments, and more particularly, to a stringing arrangement which permits one to increase the tension of the string at a given pitch.

Many different guitar designs have been promoted over the years. However, the object has been mainly to provide a more compact guitar by providing means for increasing the string length. For example, see Robinson U.S. Pat. No. 2,813,448, Civitello U.S. Pat. No. 4,078,468, Desmond U.S. Pat. No. 4,506,585, McLellan U.S. Pat. No. 4,576,080, Divetrysmith U.S. Pat. No. 5,484,773 and Steinberger U.S. Pat. No. 6,528,710. However, what these patented structures accomplish is a way to make the instrument more compact, yet provide the necessary string length to obtain the required string pitch.

This is not the object of the present invention. To the contrary, it is a principal object of the present invention to increase the tension of the string at a given pitch for electric guitars. This increases the resonance and performance of the instrument. Presently guitars are provided with either top loading or through body stringing. With top loading, the string ends coming off the bridge are anchored on the bridge assembly on the upper face side of the guitar body. This arrangement is very common and provides limited resonance and performance.

In order to increase the tension of the strings at a given pitch, guitar, particularly bass, manufacturers provide a string-through stringing arrangement wherein the strings are fed through passages coming up through the solid or chambered solid guitar body and the bridge assembly, and the strings are anchored in the back of the body. It is a principal object of the present invention to improve on this stringing arrangement whereby the resonance and performance of the instrument is further enhanced.

SUMMARY OF THE INVENTION

The stringing method of the present invention accomplishes this objective by providing double through body stringing which more than doubly compounds the desired effect.

A typical string musical instrument, particularly an electric guitar, includes a body with a neck secured to the body and over which are laterally stretched substantially parallel strings, each string being stretched over a bridge mounted on the body upper face and positioned between a tuning key disposed on a head at a distal end of the neck and an initial point of termination on the body upper face, with the bridge being disposed intermediate between the keys and the initial points of termination. However, in the embodiment of the present invention, the complete termination arrangement of the strings includes a channel in the instrument body, for each of the strings, which extends from the initial points of termination to points of final terminal securement on the instrument body which is displaced laterally from the initial points of termination, with the strings, intermediate said points, stretched over a dense non-displaceable surface whereby the strings are thereby significantly lengthened beyond the bridge in order to subject them to greater tension for a specified musical pitch. This profoundly increases the resonance and performance of the instrument.

The channels in the guitar body may be U-shaped whereby the points of final termination for the strings are on the upper face of the guitar, but spaced laterally from the initial points of termination. Alternatively, these strings may pass through the body from the initial points of termination and then extend laterally along the bottom face of the guitar body to points of final termination. The instrument body is typically either solid or a chambered solid body and the strings are typically of steel, but may be of any desired metal composition or they may be synthetic strings, such as nylon. The invention is particularly applicable to bass electric guitars.

BRIEF DESCRIPTION OF THE DRAWINGS

Other objects and advantages appear hereinafter in the following description and claims. The accompanying drawings show, for the purpose of exemplification, without limiting the scope of the invention or appended claims, certain practical embodiments of the present invention wherein:

DETAILED DESCRIPTION OF A PREFERRED EMBODIMENT

Figure 1:
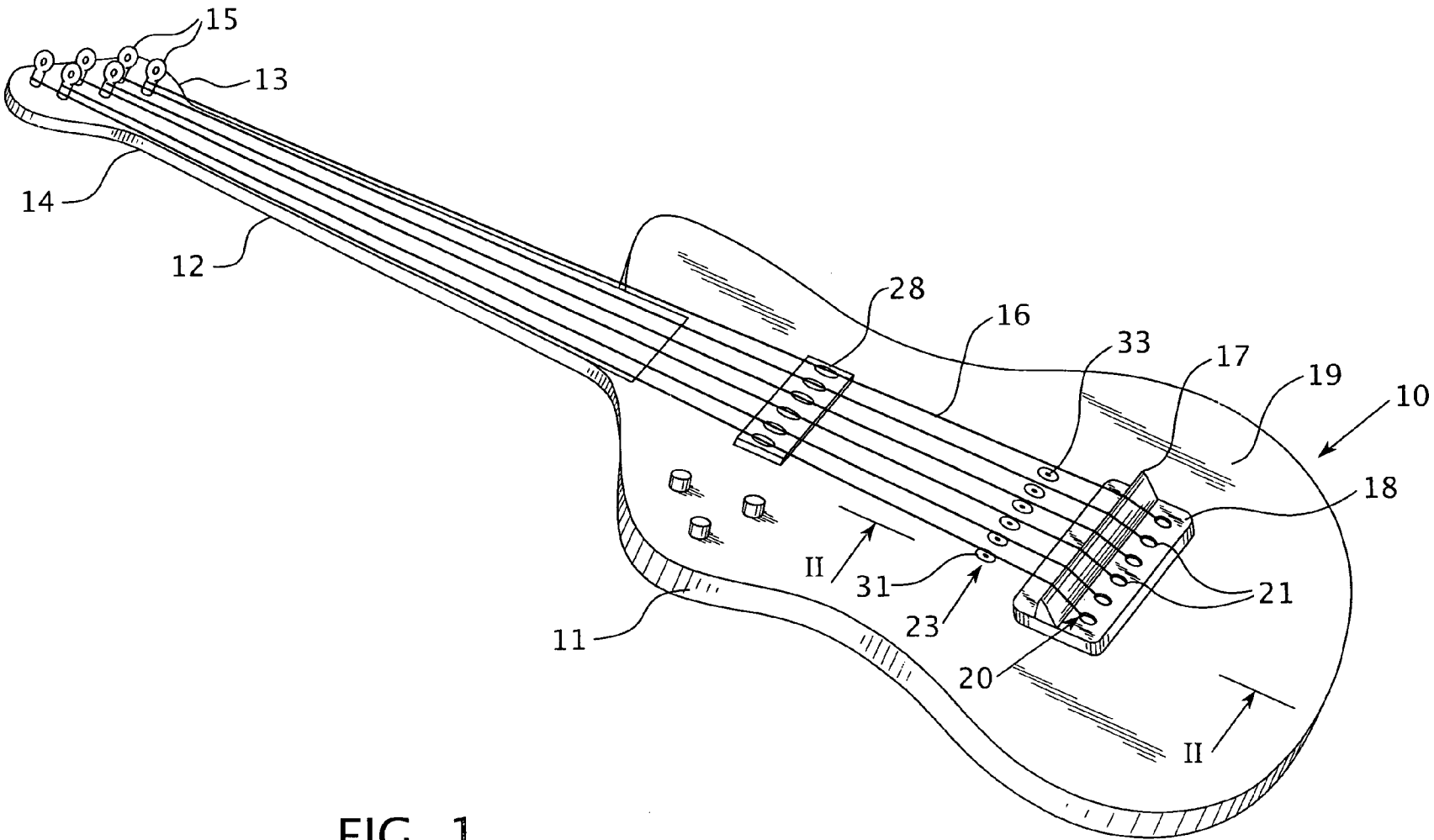
FIG. 1 is a perspective face view of the stringed musical instrument of the present invention.
Figure 2:
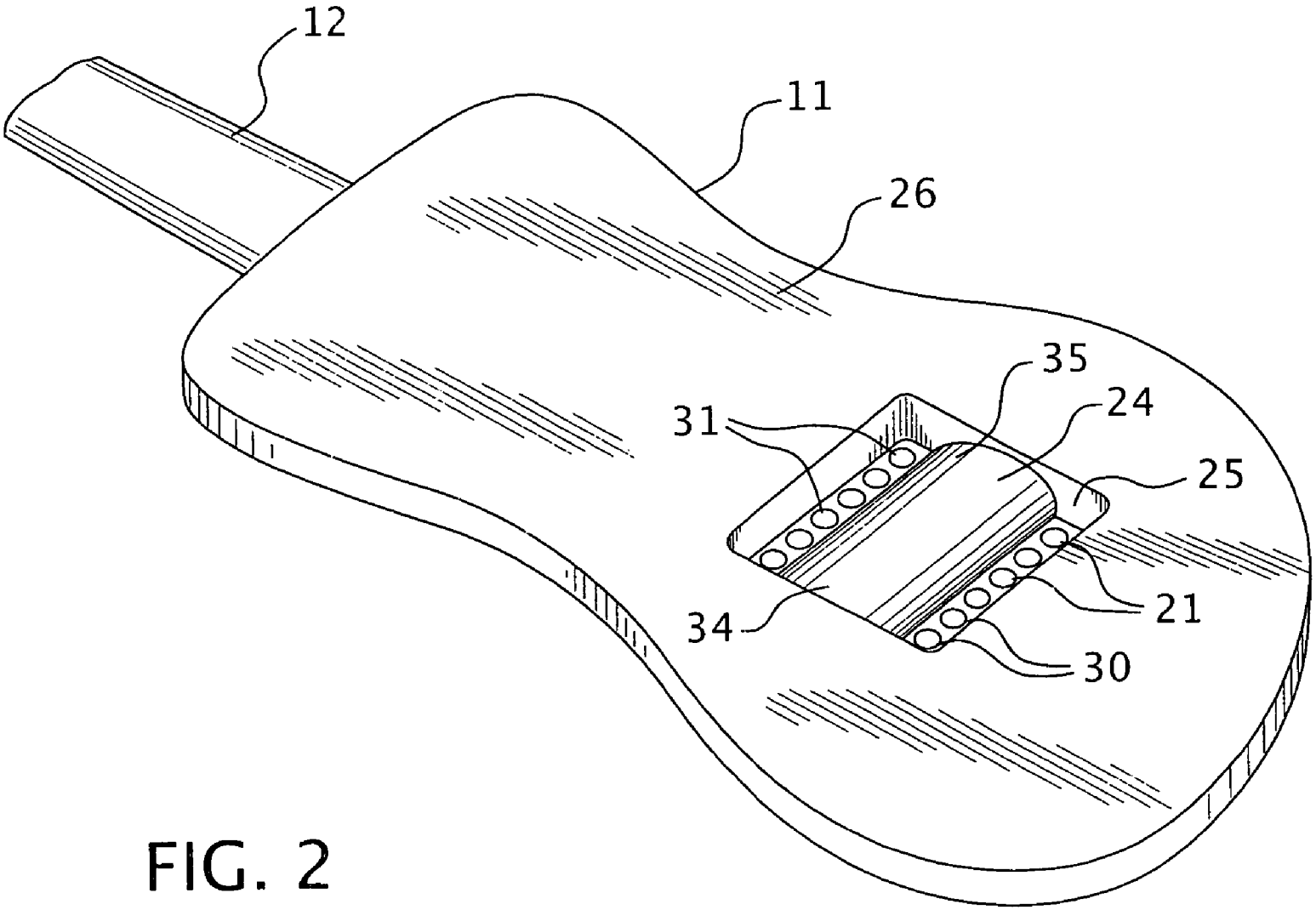
FIG. 2 is a rear view of the stringed musical instrument shown in FIG. 1 with a portion of the neck sectioned away and the strings and cover plate removed for clarity.

Referring to the drawings, the stringed musical instrument 10 of the present invention includes a body 11, which is either solid or a chambered solid body, having a neck 12 secured thereto with a head 13 at the distal end 14 of neck 12 carrying six tuning keys 15. In this embodiment the instrument is equipped with six steel strings 16. However, it must be kept in mind that the present invention is applicable to stringed instruments using strings of other types of metal and to synthetic strings, such as nylon strings. Also, the number of strings may be more or less.

The strings 16 are stretched substantially parallel over the neck 12 and body 11 as illustrated in FIG. 1. Each string is stretched over electric pick-ups 28 and bridge 17, which is part of the bridge assembly 18 mounted on the upper face 19 of body 11. The six strings are stretched between the tuning keys 15 disposed at the distal end 14 of neck 12 and initial points of termination at 20 on bridge assembly 18 at the entrance on upper face 19 of the six respective termination passages 21.

Figure 3:
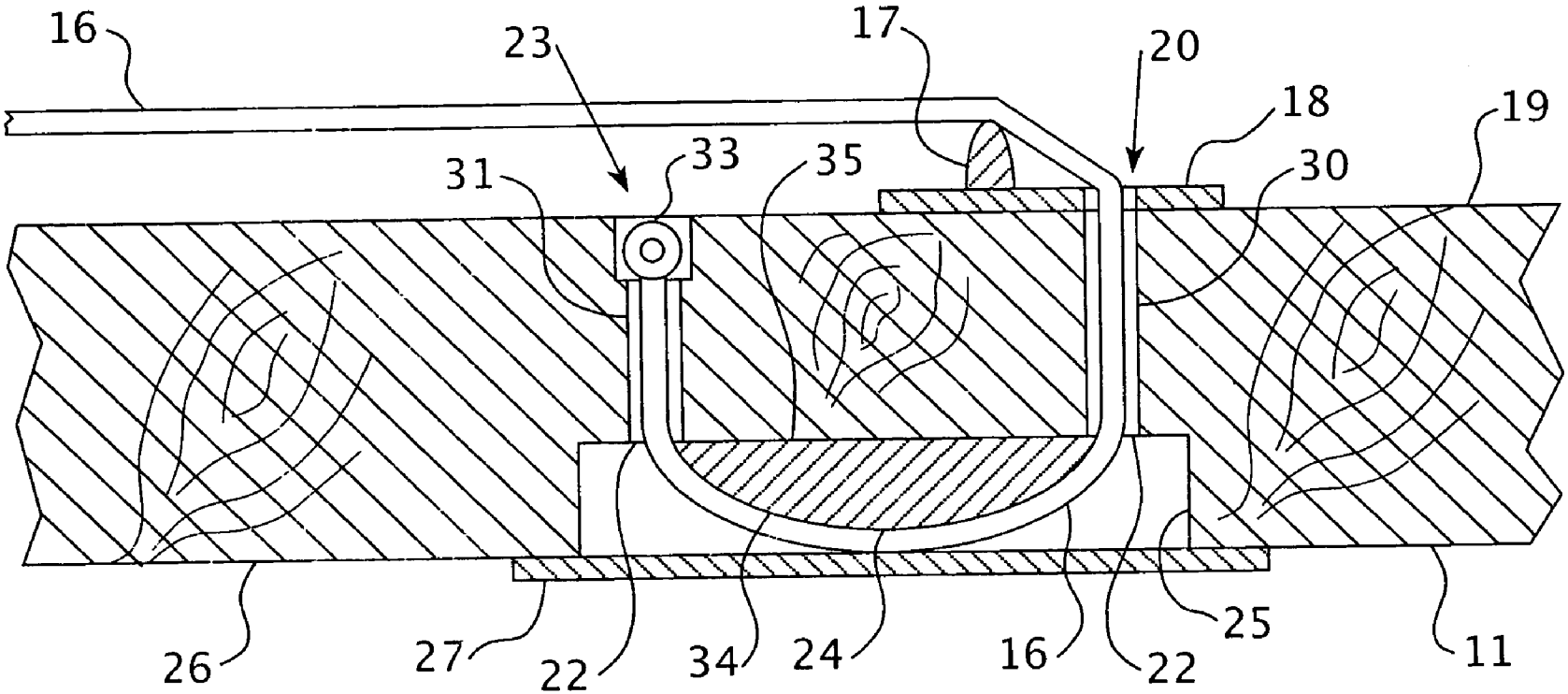
FIG. 3 is an enlarged view in vertical mid cross section of the bridge structure and stringing arrangement of the stringed musical instrument illustrated in FIGS. 1 and 2, as seen on the section line II-II of FIG. 1 at the level of the bridge assembly.

The stringing arrangement of the string musical instrument 10 of the present invention is unique in that the termination for the strings 16 after engagement with bridge 17 is comprised of a U-shaped channel 22 in body 11 for each of the six strings 16 respectively, as is best illustrated in FIG. 3. U-shaped channels 22 extend from the initial points of termination 20 to final points of terminal securement 23 wherein the six U-shaped channels 22 extend and exit to upper face 19 of body 11. These final points of terminal securement 23 are displaced on upper face 19 from the initial points of termination 20 with the strings 16 stretched over a dense non-displaceable surface 24 of insert 35 whereby the strings 16 are thereby lengthened considerably in order to subject each string 16 to greater tension for a specified musical pitch to which each string is pre-tuned. This accordingly greatly increases the resonance and performance of the instrument.

The dense non-displaceable surface 24 is positioned in cavity 25 provided in the back face 26 of body 11. Cavity 25 is covered over with access plate 27 which is secured by wood screws (not shown) to body 11 in order to cover over cavity 25. The access plate is easily removed for stringing the instrument 10.

The U-shaped channels 22 are provided by a combination of passages 30 leading from the bridge assembly 18 and the upper surface 19 of body 11 to the cavity 25, and further by the provision of passages 31 from cavity 25 to the point of terminal securement 23. At the final points of terminal securement 23, countersinks are provided in the upper face 19 to receive the terminal ends of the strings 16 respectively with typical string ball termination ends 33.

The U-shaped channels 22 are additionally provided by the inclusion of the outer or exposed surface 34 of the dense non-displaceable convex surface 24 provided by the insert 35. This insert 35 has an exposed exterior surface 24 over which the strings 16 are stretched which is dense and rigid, such as metal, dense wood, composite plastic or carbon fiber. Surface 24 is a rounded or convex curved surface which is non-displaceable. Non-displaceable meaning here that surface 24 cannot be displaced in any direction as are the rollers and/or spring arrangements of the prior art references previously discussed.

Accordingly, a double through body stringing arrangement is provided by the teachings of the present invention which permits an impressive increase in the tension of the strings 16 at their respective same given pitches thereby providing an instrument which has a considerable increase in resonance and performance.

Other alternative arrangements are possible within the scope of the claims of the present invention. For example, the final points of terminal securement 23 are shown to be displaced on upper face 19 from the initial points of termination 20 toward the neck 14 of the instrument 10. It is possible that the final points of terminal securement 23 may in fact be positioned on the opposite side of the initial points of termination 20.

Alternatively, instead of the channels through which the strings run in the guitar body being U-shaped as described, the channels may extend from the initial points of termination down through the guitar body and then the strings can from this point extend laterally on the bottom face of the guitar body to the final points of terminal securement, with the strings stretched over a dense non-displaceable surface in the areas where the strings change direction.

I claim:

1. A stringed musical instrument including a body with a neck secured thereto and over which are stretched substantially parallel strings, each tensioned to a specified musical pitch, each string being stretched laterally over said neck and upper face portions of said body and over a bridge mounted on said upper face of said body and between a tuning key disposed on a head at a distal end of said neck and an initial point of termination on said upper face of said body with said bridge disposed intermediate between said keys and said initial points of termination, said strings extending to final points of securement on said body through channels in said body for each of said strings, said strings extending downwardly from said initial points of termination and then laterally over a dense non-displaceable curvelinear surface, and thereafter upwardly to said final points of terminal securement on said body whereby said strings are thereby lengthened in order to subject each of said strings to greater tension for said specified musical pitch.

2. The stringed musical instrument of claim 1 wherein said channels are U-shaped and said points of final termination are on said upper face.

3. The stringed musical instrument of claim 1 wherein said body is selected from the group consisting of a solid body and a chambered solid body.

4. The stringed musical instrument of claim 1 wherein said strings are selected from the group consisting of metal and synthetic strings.

* * * * *